United States Patent [19]

Phillips

[11] 4,451,209

[45] May 29, 1984

[54] METHOD AND APPARATUS FOR PUMPING SUBTERRANEAN FLUIDS

[75] Inventor: Edward H. Phillips, Middletown, Calif.

[73] Assignee: Hidden Valley Associates, Inc., Middletown, Calif.

[21] Appl. No.: 245,614

[22] Filed: Mar. 19, 1981

[51] Int. Cl.[3] ..... F04B 47/00

[52] U.S. Cl. ..... 417/38; 417/360; 417/361

[58] Field of Search ..... 417/36, 38, 360, 361; 166/85, 98

[56] References Cited

U.S. PATENT DOCUMENTS

| | | | |
|---|---|---|---|
| 2,933,570 | 4/1960 | Tutthill | 417/38 X |
| 3,583,677 | 6/1971 | Phillips | 166/177 |
| 3,726,610 | 4/1973 | Butterfield | 417/361 X |
| 3,907,463 | 9/1975 | Eller | 417/360 |
| 4,050,858 | 9/1977 | Ewbank | 417/234 |
| 4,201,519 | 5/1980 | Niedermeyer | 47/38 |

*Primary Examiner*—Alan Cohan
*Attorney, Agent, or Firm*—Patrick J. Barrett

[57] ABSTRACT

An apparatus and method for pumping oil or other fluids from the earth is disclosed as using a submersible pump which is suspended in a hole drilled into the earth by means of a flexible cable. Encased in a flexible sheath with the cable are a power cable for the pump and a flexible hose to carry the oil from the pump to the surface of the earth. Control and signal wires may also be encased in the sheath for connection to transducers mounted on the pump. The pump may be easily inserted into or removed from the hole by using a reeling mechanism on the surface of the earth. The pump itself may comprise a submersible motor connected to a rotary to linear motion transducer that causes a pump barrel to reciprocate. The pump barrel moves over a stationary pump plunger, and there are ball check valves in both the barrel and plunger to control the entrance and exit of oil.

19 Claims, 13 Drawing Figures

METHOD AND APPARATUS FOR PUMPING SUBTERRANEAN FLUIDS

BACKGROUND OF THE INVENTION

This invention relates to submersible pumps and more particularly to pumps for pumping oil from the earth.

Prior art oil wells typically comprise a hole drilled in the ground, usually to a depth of a few hundred to several thousand feet, into which a reciprocating plunger type pump is inserted and connected to an actuating mechanism on the surface by a long, rigid rod assembly.

Once the hole is drilled, a tubular casing is installed in the hole and is cemented in place. The casing is then perforated at the depth of the formation from which the oil is to be pumped to allow oil from the formation to flow into the casing. Various additional procedures to maximize the flow rate of the oil from the formation, such as "fracing," may be performed in the casing before the pump mechanism is installed.

A typical pump mechanism comprises a stationary pump barrel with a check valve assembly in the bottom of the barrel. The top of this barrel is attached to rigid well tubing that supports the barrel in the casing at the desired depth. A tedious and time-consuming procedure is required to attach the well tubing to the barrel and lower the assembly into the casing. The tubing is provided in 30 foot lengths that are usually assembled in pairs after they are delivered to the well site. Each 60 foot long section of tubing must be lifted into a vertical position over the top opening in the casing by a winch in a work-over rig. The first section of tubing is fastened to the barrel with a threaded coupling by spinning the section of tubing. Then the tubing and barrel are lowered into the casing until just the top of the first section of tubing is projecting above the top of the casing. At this point a second 60 foot section of tubing is raised into position over the first section and is coupled to that section by a threaded coupling while the first section is held in place by a slip clutch assembly. Many hours are spent making up the well tubing and lowering it into the casing until the barrel is at the desired depth.

The second major component of the pump is the plunger assembly which comprises a polished rod that has an attached head portion of approximately the same diameter as the inside diameter of the pump barrel. A plunger ball check valve assembly is carried inside the head portion and packing about the periphery of the head portion prevents oil from flowing past it. Also, a pump rod guide is positioned on the pump rod. The plunger is attached to a pump rod which extends up through the well tubing to the surface of the earth where the pump actuating mechanism is located.

Lengths of pump rod, which usually are 20 feet long and are assembled at the well site into "triples" of 60 foot lengths, must be assembled to the plunger in the same manner as the well tubing was assembled or made up to the barrel. Each length of rod is lifted into place and attached to the previous length with threaded couplings that are integral with the ends of the rods. The final polished rod is the only rod which projects above the surface of the earth. A stuffing box and tee assembly are attached to the top of the well tubing at the wellhead, and the pipe to carry the oil to storage tanks couples to the tee. When the pump rod has been made up to the proper length, it must be set into the pump barrel. The top of the pump barrel has a seat for the pump rod guide. The pump rod guide must be "set" by dropping the full length of the rod assembly a short distance.

Once the well tubing and the rod assembly are in place, the actuating mechanism, known as a horse's head pump assembly is connected to the polished rod through a yoke and a cable. The assembly comprises a tower with a pivot on which is mounted a rocker arm with the horse's head at one end and a counter weight on the other end to counterbalance the weight of the horse's head and the rod. The rocker arm is driven by a connecting rod coupled to a crank on a gear box, which is belt driven by an electric motor. The motor provides the force to overcome friction and lift the liquid pumped as the rocker arm is raised and lowered.

The pump is commonly known as a sucker rod pump and delivers fluid on both the up and the down strokes. The diameter of the rod above the head portion is approximately 0.7 times the inside diameter of the pump barrel so that about half the oil flowing through the plunger check valve on the down stroke of the rod flows into the volume between the rod and pump barrel created above the packing on the head portion by the down stroke and the other half flows up toward the surface of the earth. On the upstroke of the rod, oil is sucked into the barrel through the barrel check valve while the column of oil in the well tubing above the plunger packing is lifted up to the surface of the earth, including that stored in the volume between the rod and pump barrel. Thus the net volumes pumped during the down and up strokes are approximately equal. However, if the head of oil in the casing outside the pump barrel is not sufficient, the pump may reach a "pumped off" condition in which dissolved gasses in the oil may be released as it is sucked through the barrel check valve during the up stroke, and part of the volume of the barrel will be filled with gas instead of liquid. In such a case, oil will not be forced into the plunger check valve during the first part of each down stroke and the column of oil above the packing will actually descend from the surface of the earth during that time. This will reduce the volumetric efficiency of the pump and can produce destructive "water-hammer" like impacts on every down stroke, thus shortening pump life.

In the prior art, the pumped off condition was usually detected by an on site person known as a "pumper" putting his hand on the polished rod where he could feel the vibration caused by the plunger hitting the top surface of the oil in the barrel. He would then adjust a timer on the pump motor so that the pump would shut off at approximately the time during each pumping cycle when the pumped off condition was reached. However, to keep a pump working at maximum efficiency requires constant attention by an experienced pumper. There are other methods of determining how long a pump should be run each day for maximum efficiency, but they usually involve even greater expense or complexity than the method just described.

One method of determining the height of the oil in the casing is to use a sound transducer to monitor sound waves reflected off the couplings when it is fired down the well by a blank firing gun. The data must be monitored and interpreted by an engineer, which is costly and can only be done infrequently. It is also possible to place pressure transducers at the bottom of the well at the pump to measure the head of oil above the pump inlet, but a wire must be run down the casing along with the well tubing to connect to the transducer. This is very time consuming, often requiring another day when the tubing string is being made up, and the wire is so delicate in comparison with the tubing and rods that the wires are often broken during makeup and must be repaired causing further time delay. One solution proposed for this problem in the prior art is shown in U.S. Pat. No. 3,434,682 entitled "Wire Positioning and Protective Device," issued March 25, 1969.

Although the basic sucker rod pump is simple and reliable, it none-the-less requires periodic maintenance due to the wearing of parts, clogging of perforations in the casing or the valves by sand, paraffin or other substances, etc. When maintenance is required the well must be shut down for several days while the pump is laboriously disassembled by reversing the make up process described above. This disassembly is costly not only because of the 4 to 5 man crew required to perform the work, but because the well is not producing during the several days required to disassemble, service and reassemble the pump.

Further drawbacks to the sucker rod pump involve the efficiency of its operation, the complexity of pump selection parameters and safety. The motor driving the gear box is usually a much higher horsepower motor than would be necessary just to lift the column of oil to the surface of the earth because of the high friction and starting inertia involved in a pump that has several thousand feet of pump rod weighing thousands of pounds connected to an equally heavy rocker arm assembly. For example, pumping 30 barrels per day from a 4000 foot deep well results in a hydraulic output of one horsepower, but often a 30 horsepower motor is used. Pump selection is complicated by the fact that the tubing and rods may be resonant or nearly resonant at the frequency of the pump's oscillation, and the relative extension and contraction of the rod and tubing may be on the order of the stroke length of the rocker. Careful selection of pump stroke and rocker stroke length and frequency must be made to avoid undesirable conditions.

Safety concerns involve both workers and strangers, such as children, who may wander into an oil field. Since many pumps are on timers, a person may be near or in contact with a pump thinking it is not in operation when it may suddenly start up without warning. Such occurrences have caused serious injuries in the past. In addition many workers' injuries have resulted from fatigue during the long and strenuous process of putting the pump in the casing or removing it for maintenance.

Other types of pumps, usually more expensive, may be used. For very high production volumes, such as are encountered in certain water flood, secondary recovery operations, submersible electric motors of up to 50 feet in length (at one horsepower per foot) are used to drive multi-stage axial-centrifugal hybrid pumps of up to 600 stages. Each stage is a rotor and stator combination about one inch in length. For moderate production volumes at extreme depths hydraulic piston driven axial stroke pumps are used. These pumps have very complex valving reversing the direction of the piston every stroke and they are powered by triplex pumps on the surface of the earth. In these cases either wires or rigid hydraulic tubing must be placed in the hole which complicates the installation appreciably.

SUMMARY OF THE INVENTION

In accordance with the preferred embodiment of the present invention, a submersible oil pump is attached to a flexible cable which suspends the pump in the well casing. Power is provided to a motor in the pump by a flexible power cable, and the oil from the pump is carried to the surface of the earth by a flexible hose. The support cable, power cable and hose are all encased in a protective sheath to make a single flexible line. Before the pump is placed in the hole, the flexible line is wound on a reel, and the pump is lowered into the casing by unwinding the reel. When it is desired to remove the pump from the hole, the flexible line may again be wound on the reel.

This reel may conveniently be mounted on the back of a truck so that it can be easily transported from one well site to another. In addition to the reel, the truck may also have a guiding mechanism to guide the flexible line from the wellhead to the reel and evenly distribute the flexible line on the reel. The guiding mechanism may comprise a pulley hingeably mounted on a boom attached to the truck, together with an oscillating drive for slowly pivoting the reel back and forth about a vertical axis on the truck. As the flexible line passes over the pulley and is wound on the reel it is evenly distributed over the surface of the reel due to this back and forth motion of the reel.

The pump may comprise a submersible, sealed motor driving a rotary to reciprocating motion transformer. The motion transformer may be connected to a moving pump barrel having an inlet valve and reciprocating on a fixed plunger which has as outlet valve.

If it is desired to place devices such as pressure transducers, sonic transducers, or continuous heaters for the flexible hose in the well, wires can also be included in the protective sheath of the flexible line. Thus no extra labor is required to install this pump in the well hole with such additional devices and the likelihood of breakage of the wires is greatly reduced. In addition, pumping efficiency can be maximized by using an automatic control system to control the pump in response to conditions in the well measured by transducers such as a pressure transducer.

One of the great advantages of the present invention is the saving in labor and time in the installation and removal of a pump from a hole. Where in the past, placing a pump in the hole took several days, it need take only a matter of hours with the present invention. In addition a smaller crew is required. Safety should be increased significantly because all of the moving parts are below ground, out of the reach of curious strangers or careless workers. Since the installation and removal can be accomplished in less time than the prior art and requires less manual labor, there is less opportunity for injuries to workers.

DETAILED DESCRIPTION OF THE PREFERRED EMBODIMENT

Figure 1:
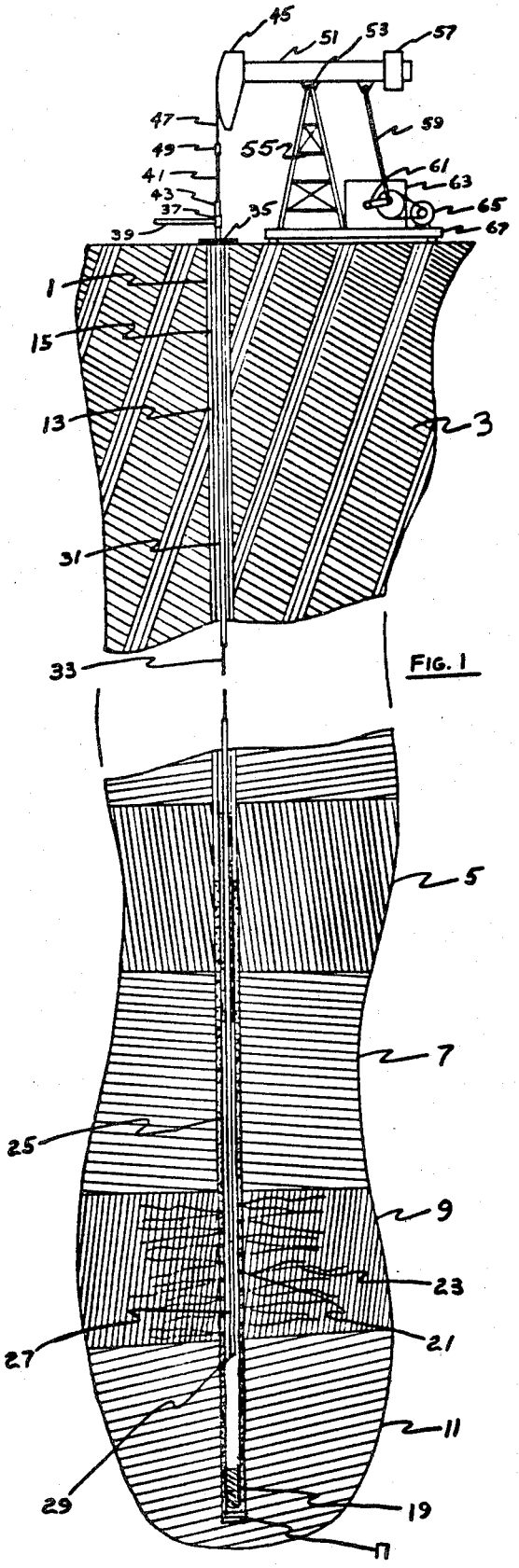
FIG. 1 shows a cross sectional view through a hole drilled in the earth with a prior art oil pump installed therein.
Figure 2:
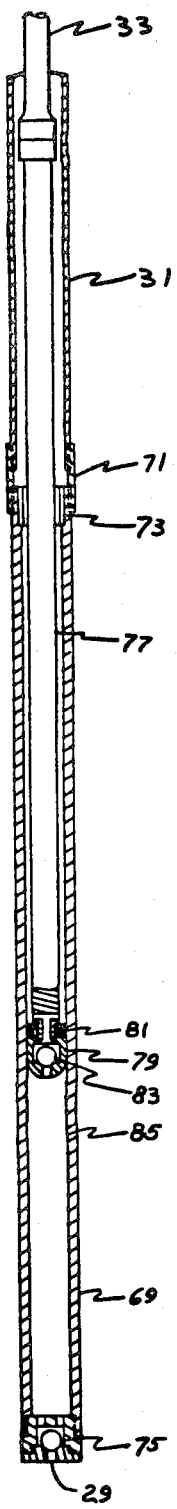
FIG. 2 shows a cross sectional view of a prior art oil pump.

FIGS. 1 and 2 show a prior art oil pump such as that described in the background of the invention. A hole 1 is drilled through various subterranean formations here denoted as an overburden 3, a water bearing zone 5, overbearing strata 7, a producing zone 9, and underbearing strata 11. A casing 13 inserted in the hole is smaller than the inside diameter of the hole and leaves an annular space 15 which may be partially filled with drilling mud and debris. Cement 17 is driven into annular space 15 by a bullnose 19 to seal off the various strata from one another and to prevent water, for example, from flowing into the oil producing zone.

Perforations 21 in the casing and fractures 23 in the producing zone formation are formed to allow oil 25 to flow into the casing. A pump 27 with an inlet 29 is suspended in the casing by tubing 31 and is actuated through a rod 33. At the surface of the earth the casing and tubing are fastened to a wellhead 35 where a tee 37 has a pipe 39 to carry the oil to a storage tank (not shown). A polished rod 41 connected to well rod 33 passes through a stuffing box 43 and is also connected to a horse's head 45 through a cable 47 and yoke 49. The horse's head is on a rocker arm 51 supported on a pivot 53 on a tower 55. The rocker arm is counterbalanced by a counter weight 57 and is driven by a crank 61 through a connecting rod 59. The crank is connected to a gear box 63 which is driven by a motor 65, and both the motor and the gear box sit on a frame 67.

The pump has a barrel 69 connected to tubing 31 by a coupling 71. At the top end of the barrel there is a pump rod guide 73; and, at the bottom, an entrance ball check valve 75 connected to inlet 29. Well rod 33 is connected to a pump rod 77 on which is mounted a plunger 79 with packing 81 and a plunger ball check valve 83. The plunger is just slightly smaller than the bore 85 of the barrel.

Figure 3:
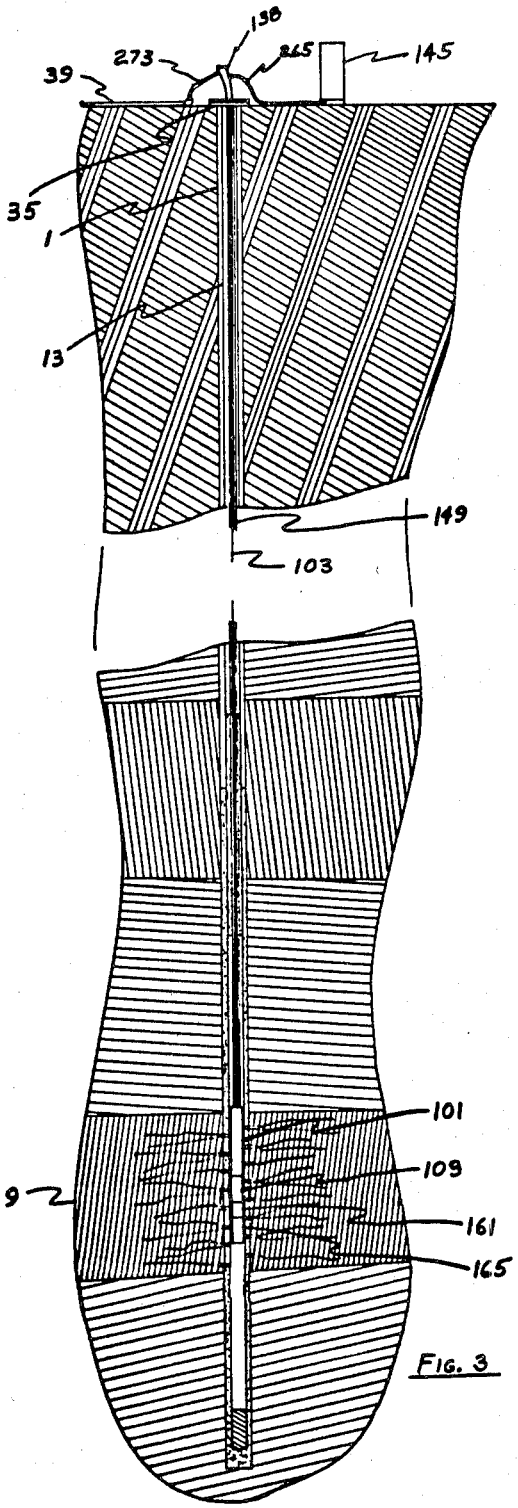
FIG. 3 shows a cross sectional view through a hole drilled in the earth with a pump in accordance with the preferred embodiment of the present invention installed therein.
Figure 4:
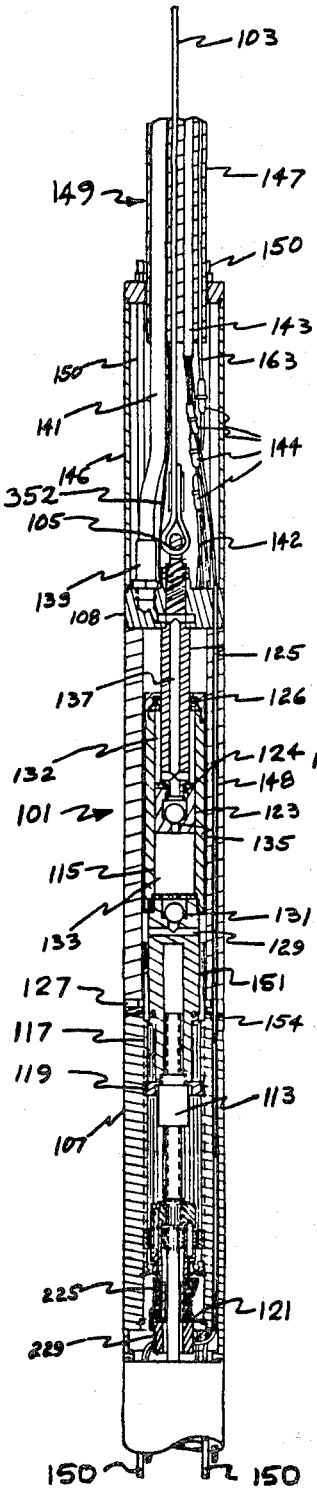
FIG. 4 shows a cross sectional view of a pump in accordance with the preferred embodiment of the present invention.

In FIG. 3 a pump 101 in accordance with the preferred embodiment of the invention is shown suspended in hole 1 within casing 13. The pump itself is shown in greater detail in FIG. 4. A steel cable 103 is connected to the top of the pump by a lift eye 105 and to wellhead 35 to support pump 101 at the proper depth in hole 1.

The pump components are mounted in a body 107 having a top plate 108 which is attached to lift eye 105. At the bottom of the body is a submersible motor 109 coupled to a lead screw 111 A ball nut 113 on lead screw 111 is coupled to a moveable pump barrel 115 and has splines 109 at the lower end of the pump barrel. The splines engage grooves 117 in body 107 to permit axial movement of the barrel in the body. When the motor rotates lead screw 111, ball nut 113 will cause pump barrel 115 to move away from or toward the motor depending upon the direction of rotation of the motor. In order to cause the pump barrel to reciprocate, a limit switch assembly 121 is provided to change the direction of rotation of the motor when the barrel reaches the limit of its travel in each direction. These components are shown in greater detail in FIG. 6.

Pump barrel 115 slides over a stationary plunger 123 that is mounted on a pump rod 125. The pump rod is fastened in turn to pump body top plate 108. There is packing 124 around the plunger as well as packing 126 at the top of the pump barrel. When pump barrel 115 moves downward it pulls oil in through an inlet 127 in pump body 107 and oil is also pulled into the interior of pump barrel 115 through an inlet 129 and a ball check valve 131.

The diameter of pump rod 125 is selected to be the inverse of the square root of two, times the inside diameter of pump barrel 115, thus leaving an annular space 132 between the pump rod and barrel. When the pump barrel moves upward, it forces oil in region 133 through a check valve 135 in plunger 123 into a passageway 137 in pump rod 125 and into annular space 132. Because of the ratio of the pump rod outer diameter to the pump barrel inner diameter, half of the oil will flow into passageway 137 and the other half into annular space 132. The oil that flows into annular space 132 on the up stroke of the pump barrel will be forced into passageway 137 on the down stroke by packing 126. Passageway 137 is connected to an oil outlet 139 and thus half of the oil that enters the pump barrel will flow through the outlet on the up stroke of the pump and the other half on the down stroke, maintaining a continuous flow of oil through the outlet.

A flexible hose 141 is coupled to outlet 139 and is used to carry the oil up to the wellhead where it connects to pipe 39 through a junction box 138. Power is supplied to motor 109 through a power cable 143 which is also connected through junction box 138 to a control box 145 on the surface of the earth. Wires in power cable 143 are connected through connectors 144 to power leads 142 which carry the electrical power to motor 109. The power leads are enclosed in a passageway 148 in body 107. Steel cable 103, hose 141 and power cable 143 are all encased in a flexible, protective sheath 147 to form a single flexible line 149. A cover 146 is fastened to top plate 108 to protect lift eye 105, outlet 139 and connectors 144 and to provide convenient access to these components when the pump needs to be serviced. Four threaded rods 150 pass through cover 146, top plate 108, body 107 and motor 109 to fasten the assembly together.

In order to prolong the life of the motor, it is sealed in clean oil 152 by an upper seal 151 and a lower seal 153. These seals are preferrably convoluting diaphragms, sold under the name Bellowframs, which permit translational movement without requiring a sliding seal that might admit contaminants. Seal 151 is attached between pump body 107 and the lower portion of pump barrel 115, and the seal moves with the reciprocation of the pump barrel. Lower seal 153 is mechanically biased by a spring 155 to maintain a slight positive pressure differential between clean oil 152 and the oil in the casing. Spring 155 and lower seal 153, together with a vent hole 157, also allow for the changing volume of oil below the motor due to the changing volume of oil above the motor as the pump barrel reciprocates. There is also a seal 154 in passageway 148 to prevent contamination from getting into the motor through the passageway.

Figure 5:
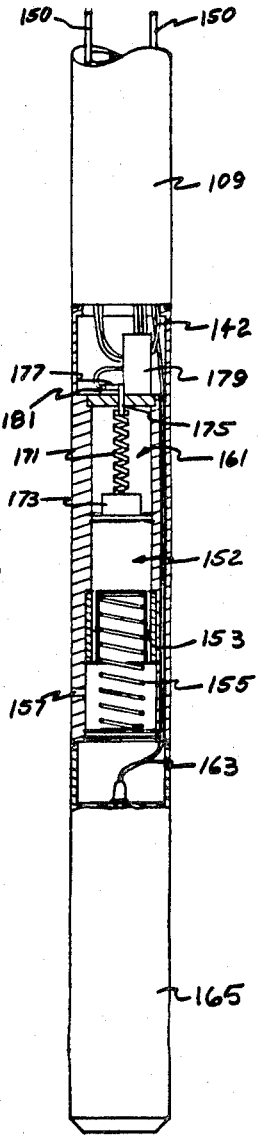
FIG. 5 shows a cross sectional view of a pressure transducer for use with a pump in accordance with the preferred embodiment of the present invention.

A pressure transducer 161 is mounted below motor 109 for sensing the pressure of the oil in the hole at the pump. Signals from pressure transducer can be carried to the surface of the earth by wires in sheath 147, if desired, for recording or control purposes. Pressure transducer 161 can also be used for controlling motor 109 as shown in FIG. 5. Pressure transducer 161 comprises a helical coil Bourdon tube 171 mounted on an evacuated chamber 173. A rod 175 is fastened to the top of Bourdon tube 171, and a moving electrical contact 177 is fastened to the rod. Power leads 142 are connected to a power relay 179 which in turn is connected to motor 109 to switch the power to the motor on and off. One of the power leads is also connected to one end of the relay solenoid and the other end of the solenoid is connected to a stationary contact 181. When the oil pressure in the hole is relatively low, for example 25 psi, the Bourdon tube will hold moving contact 177 in contact with stationary contact 181. As the pressure of the oil increases the Bourdon tube will start to "unwind" and the moving contact will be rotated away from the stationary contact as when oil pressure rises above a predetermined limit. An example of this type of pressure transducer is described in greater detail in U.S. Pat. No. 3,279,258 entitled "Environmental Measuring Instrumentation," granted Oct. 18, 1966.

Power leads 142 are connected to the normally open contacts of power relay 179 so that when moving contact 177 is not in contact with stationary contact 181 and consequently no power is being applied to the solenoid of the power relay, power will be applied to the motor. When contacts 177 and 181 close, power is removed from the motor. It should be noted that these contacts are in clean oil 152 to prolong their operating life. The pressure of the oil in the hole is transmitted to the pressure transducer through seal 153 which has a relatively insignificant bias exerted against it by spring 155, resulting in a pressure differential between clean oil 152 and the oil in the hole of 3 to 4 psi.

A sound transducer 165 can also be mounted below motor 109 for inducing sonic distrubances in the oil producing formation to increase the production of oil from the formation. The operation and use of such sonic transducers is described in detail in my following U.S. Pat. Nos. 3,527,300 issued Sept. 8, 1970 for an "Electromechanical Transducer for Secondary Oil Recovery and Method Therefor"; and No. 3,583,677 issued June 8, 1971 for an "Electromechanical Transducer for Secondary Oil Recovery". Power is supplied to the sound transducer through a wire 163 which also passes from sheath 147 through another passageway parallel to passageway 148.

Figure 6:
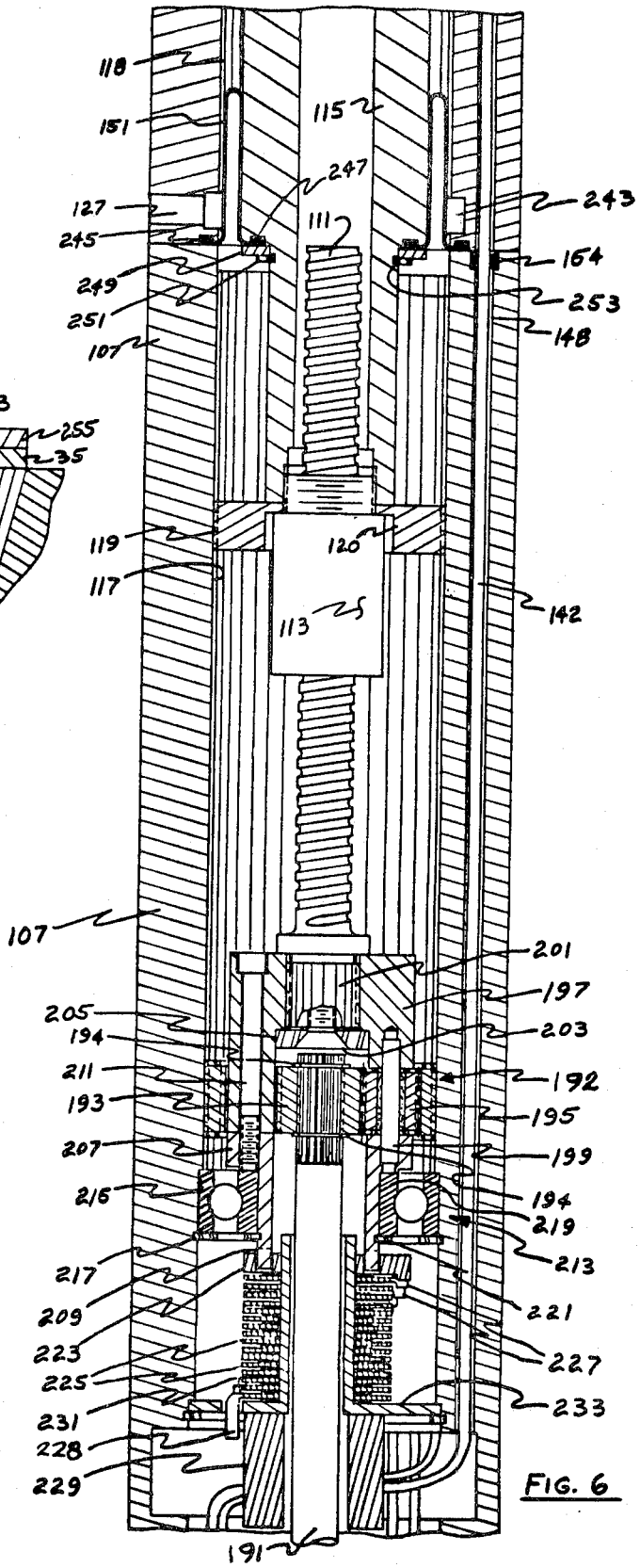
FIG. 6 shows a cross sectional view of a planetary gear set and of a splined drive for a pump barrel in accordance with the preferred embodiment of the present invention.

FIG. 6 shows an enlarged cross section of the coupling between motor 109 and lead screw 111. Motor 109 has a splined output shaft 191 with a sun gear 193 of a planetary gear set 192 mounted on it with retaining rings 194. Sun gear 193 engages planet gears 195 which are mounted on a planetary carrier 197 on spindles 199. Planetary carrier 197 has a splined hole that mates with a splined end 201 of lead screw 111, and these two parts are held together by a screw 203 and washer 205. A castellated end cap 207 with a plurality of pins 209 is fastened to planetary carrier 197 with bolts 211. A ball bearing 213 has an outer race 215 held in body 107 by a retaining ring 217 and an inner race 219 held in end cap 207 by a retaining ring 221. Ball bearing 213 acts both as a thrust bearing and a rotational bearing for planetary gear set 192.

Pins 209 engage an appertured plate 223 on a stack of washers 225, each, including the appertured plate, having a tab 227. With each rotation of appertured plate 223 the tab on one of the washers contacts the tab on the next lower washer and causes it to turn with the washers above it. A tab 228 on the bottom washer engages a reversing switch 229 for motor 109, and when the bottom washer is turned by the washer above it, it causes the motor to reverse direction. The number of rotations between reversals is determined by the number of washers in the stack which is, in turn, determined by the length of the throw of the pump. For example, for a six inch pump throw with a lead screw having four threads per inch, there should be approximately 26 or 27 washers in the stack, depending on the widths of the tabs. Each of the washers is separated by a bearing washer 231, and the washers are assembled about a sleeve 233

Motor 109 is a three phase, four pole motor of the type commonly available from such suppliers as Franklin. Reversing switch 229 is a double pole, double throw switch which reverses two of the three power leads to the motor when it is actuated by the bottom washer 225. Since the motor is relatively long and thin, it has relatively low rotational inertia and can be reversed comparatively quickly. For example, a motor operating at 1725 rpm can be reversed in about 60 milliseconds. With a gear reduction of 3.33:1 in the planetary gear set and a six inch pump throw as discussed above, the motor will operate for about 3 seconds in each direction, so that the time required to reverse the motor is only about 2% of the operating time.

Figure 7:
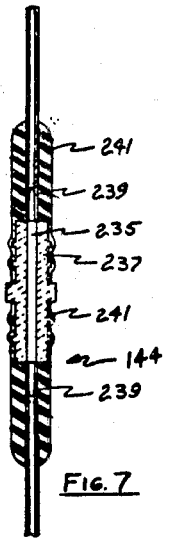
FIG. 7 shows a cross sectional view of an electrical connector.

FIG. 7 shows a cross sectional view of one of the connectors 144. A conductor 235 in a ceramic body 237 has common spring connectors 239 slipped over each end. Wires are soldered to each connector 239, and rubber hoods 241 are over the connectors 239 and ceramic body 237.

FIG. 6 also shows a cross section of the portion of the pump where ball nut 113 on lead screw 111 is threaded into pump barrel 115, clamping a splined member 120 with splines 119 between the ball nut and the barrel. Oil flowing through inlet 127 in body 107 flows into an annular groove 243 and from there past upper seal 151 through grooves 118, which may be a continuation of grooves 117, and into inlet 129. These grooves in cooperation with the upper seal act as a filter to keep undesirably large particulate matter from entering the pump.

One end 245 of upper seal 151 is clamped between two cylindrical portions of body 107 and another end 247 of upper seal 151 is clamped between pump barrel 115 and a clamp ring 249. Clamp ring 249 is held in place by a retaining ring 251 that fits in a tapered groove 253 in the pump barrel.

Figure 8:
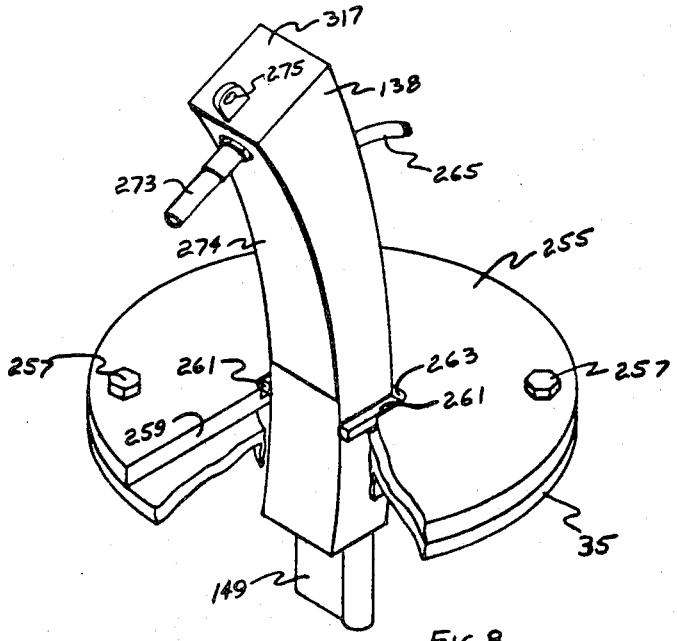
FIG. 8 is a perspective view of a junction box at a wellhead in accordance with the preferred embodiment of the present invention.

FIG. 8 shows a partially cut away perspective view of well head 35 supporting junction box 138. A support plate 255 is bolted to wellhead 35 with bolts 257. The support plate has a slot 259 in it to permit it to be slid off of the wellhead while flexible line 149 is in the hole. Welded on two sides of junction box 138 are a pair of support bars 261 that sit in a milled groove 263 in support plate 255 to support the junction box when it is in place.

Figure 9:
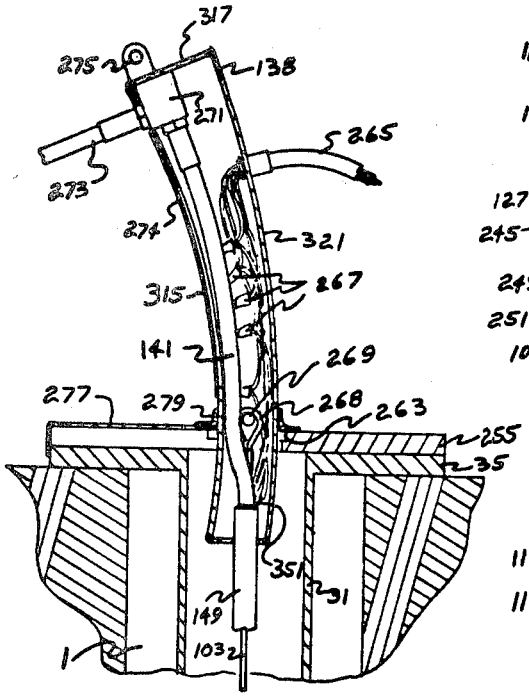
FIG. 9 is a cross sectional view of the apparatus of FIG. 8.

In FIG. 9 the wellhead and the junction box are shown in cross section. A master cable 265 carries power cable 143 and wires 163 from junction box 138 to control panel 145. The various conductors in master cable 265 are joined to the respective conductors from flexible line 149 by connectors 267. Steel cable 103 is formed into a loop 268 which is supported by a pin 269 in the junction box. Flexible hose 141 is connected to a junction coupling 271 to which is also connected a hose 273 that carries the oil to pipe 39. The various items in the interior of junction box 138 are accessible by removing a cover plate 274 on one side of the junction box. A lift eye 275 is provided at the top of junction box 138 to facilitate lifting the junction box, flexible line and pump out of hole 1. Slot 259 provides access to the well for testing and inspection purposes, and an access cover 277 is attached to support plate 255 to keep out dirt, etc. when access to the well is not needed. When access cover 277 is in place, a rubber boot 279 is also installed around the junction box where it passes through the support plate to seal the well against contamination.

Figure 10:
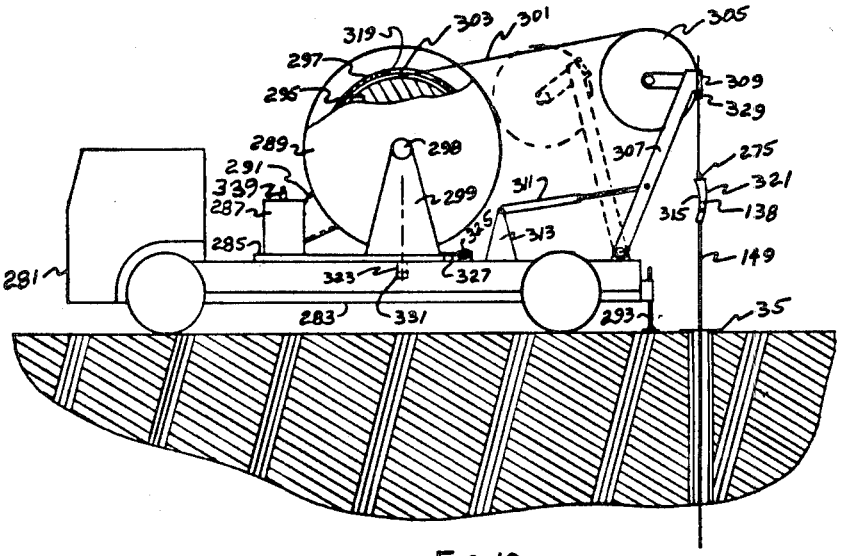
FIG. 10 shows a mobile pump installation and removal apparatus in accordance with the preferred embodiment of the present invention.
Figure 11A:
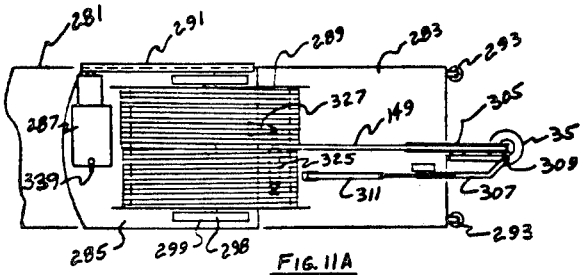
FIGS. 11A and 11B are top views of the apparatus of FIG. 10.
Figure 11B:
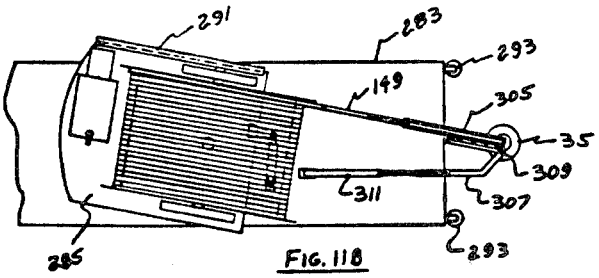

FIGS. 10, 11A and 11B shows a mobile installation and removal apparatus for pump 101. A truck 281 has a chassis 283 supporting a platform 285 on which is mounted a motor and gear reduction unit 287 driving a reel 289 through a drive chain 291. The truck is stabilized in position over the well by outriggers 293. Reel 289 comprises an inner drum 295 and an outer drum 297 that is concentric with the inner drum. Inner drum 295 rotates about an axle 298 on a support 299, and it is driven by drive chain 291. A cable 301 is attached to inner drum 295 and passes through a slot 303 in outer drum 297 and over a pulley 305 mounted on a boom 307 with a hinge 309 parallel to the longitudinal axis of the line between the pulley and the wellhead. Cable 301 is attached to lift eye 275 by a bolt or a clevis. Boom 307 has an extended position, shown in solid lines, and a retracted position, shown in dotted lines. A hydraulic jack 311 attached to chassis 283 by a support 313 moves the boom from the retracted position, used for travel, to the extended position, used when a pump is being installed or removed.

To remove a pump from a well, cable 301 is attached to lift eye 275 after access cover 277 and rubber boot 297 have been removed and master cable 265 and hose 273 have been disconnected. When motor 287 starts to turn inner drum 295, junction box 138 will be lifted off of support plate 255 so that it can be removed. To facilitate passage of junction box 138 over pulley 305, one side 315 of the junction box has substantially the same radius of curvature as the pulley. After the junction box passes over the pulley it will be pulled into slot 303 in outer drum 297, and the top 317 of the junction box will abut against one end 319 of slot 303, causing outer drum 297 to turn with inner drum 295. A second side 321 of junction box 138, opposite side 315, has substantially the same radius of curvature as outer drum 297 so that the flexible line will wind smoothly over the surface of the outer drum and the junction box.

In order to distribute the flexible line evenly over the surface of outer drum 297, a mechanism is provided to oscillate the reel back and forth as the flexible line is wound onto the reel. Platform 285 is mounted on an axle 323 on the center line of the reel. A hydraulic jack 325 has one end attached to chassis 283 and the other end, to an arm 327 mounted on platform 285. A potentiometer 329 is attached to hinge 309 so that the resistance of the potentiometer varies linearly with the angle between pulley 305 and boom 307. Likewise a potentiometer 331 is coupled to axle 323 so that its resistance varies linearly with the angle between platform 285 and chassis 283.

Figure 12:
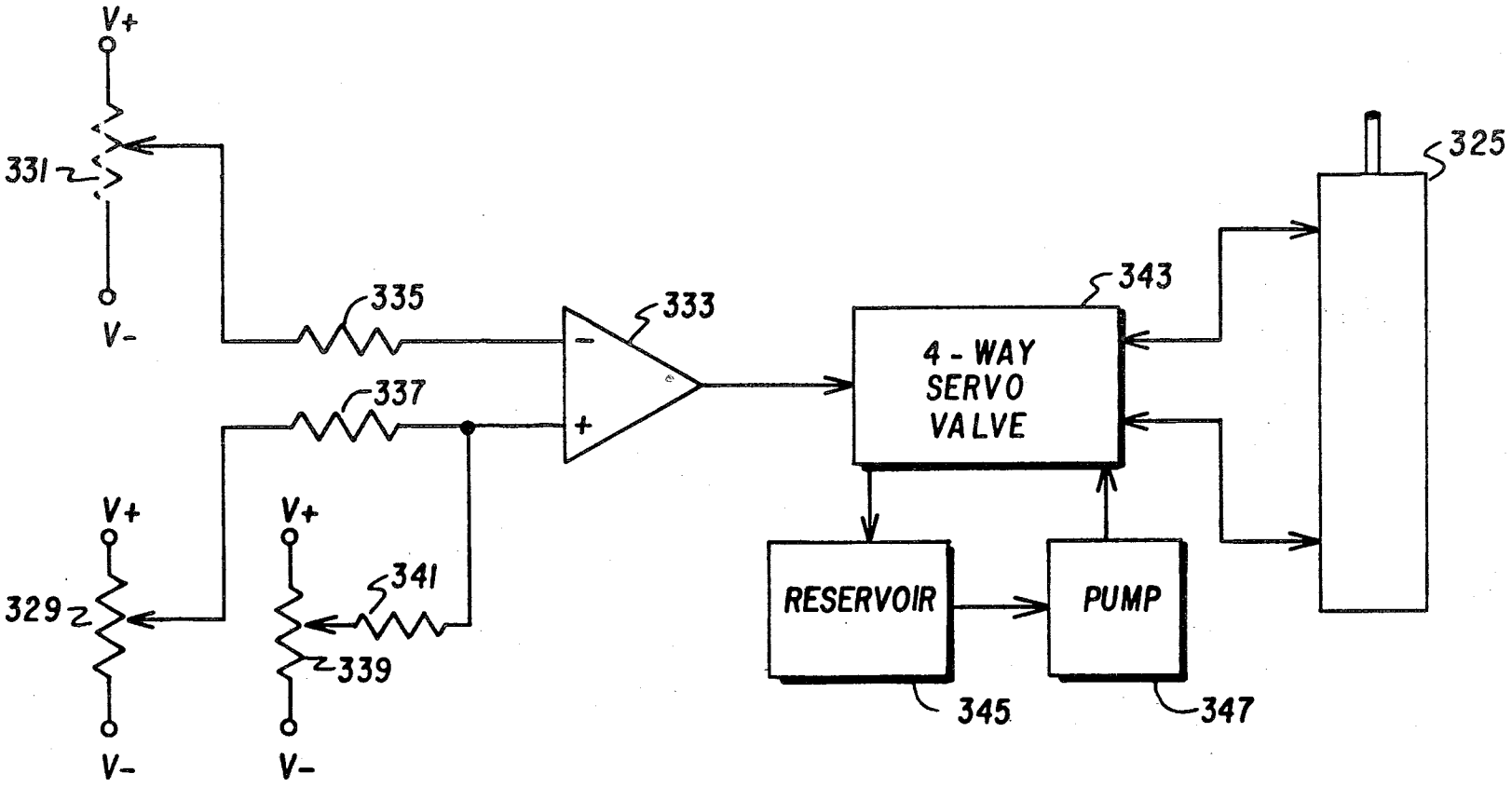
FIG. 12 is a schematic diagram of a control system for the apparatus of FIG. 10.

Both of the potentiometers are connected to a control system shown in FIG. 12 that controls the extension of hydraulic jack 325. The ends of the potentiometers are connected to positive and negative voltage supplies, V+and V−. The arm of potentiometer 331 is connected to the negative input of a differential amplifier 333 through a summing resistor 335, and the arm of potentiometer 329 is connected to the positive input of the amplifier through a summing resistor 337. A manual adjustment potentiometer 339 is also provided so that the angular position of the platform can be adjusted by an operator as necessary, such as when one layer of flexible line has been laid down and the next layer is to be started. Voltages V+ and V− are also applied across potentiometer 339, and the arm of that potentiometer is connected to the positive input of amplifier 333 through a summing resistor 341.

The output of amplifier 333 is connected to a four-way servo valve 343 which in turn is connected to hydraulic jack 325 and to a hydraulic fluid reservoir 345 and a hydraulic pump 347. As the flexible line starts to wind on the outer drum one row of line will be laid down next to the previously wound row and this positional displacement of the flexible line on the drum will cause the pulley to turn on hinge 309, thereby also turning potentiometer 329 and changing the position of its arm. The resulting output signal from amplifier 333 will cause more hydraulic fluid to be supplied to one end of hydraulic jack 325, changing the angular position of platform 285. The angular position of the platform is fedback to the positive input of amplifier 333 as the position of the arm of potentiometer changes. This results in the appropriate amount of fluid being supplied to the hydraulic jack so that the angular velocity of the platform is maintained at the appropriate value to lay the flexible line evenly on the outer drum. When a new course of flexible line is ready to be laid on the drum the operator may need to use the manual adjustment potentiometer to adjust the position of the platform to start the course properly.

When a pump is first being installed in a well in accordance with the present invention, the flexible line is precut to the desired length, at a distribution center for example, and both ends of the flexible line are stripped. Next the steel cable, the power cable, the flexible hose and any other wires in the flexible line are connected to the pump at one end and to the junction box at the other end. Then the flexible line is wound onto reel 289 and the assembly is transported to the well site. There, the pump is lowered into the hole using the pump installation and removal apparatus to unreel the flexible line. When the pump has been completely lowered into the hole and the junction box is seated in support plate 255, access cover 277 and rubber boot 279 are installed. Once hose 273 and cable 265 are connected, the pump is ready to be turned on at the control panel.

In some cases it is desirable to heat flexible hose 141 to enable the oil being pumped to flow more freely. In such cases a heater can be provided around flexible hose 141 and power can be supplied to the heater by a wire 351 in the flexible line. At the pump, the heater is connected to top plate 108 by a wire 352. The steel cable can be used as the return current path for both the heater and the sound transducer.

I claim:

1. A method of extracting fluid from the earth through a hole formed in the earth comprising the steps of:

lowering submersible pump means into the hole with a flexible support member;

measuring the pressure of the fluid in the hole at the pump means;

applying power to the pump means through flexible power conducting means, encased in a common protective sheath with the flexible support member, in response to the pressure of the fluid; and transporting fluid pumped by the pump means to the surface of the earth through flexible fluid transport means encased in a common protective sheath with the flexible support member and the flexible power conducting means.

2. A method as in claim 1 wherein the step of lowering the pump means further comprises unreeling the commonly encased flexible support member, flexible power conducting means and flexible fluid transport means from a storage reel as the pump is being lowered into the hole.

3. A method as in claim 1 further comprising the steps of providing a sonic transducer coupled to the pump means and energizing the sonic transducer after the pump means has been lowered into the hole to increase the rate of production of fluid from the earth.

4. A system for pumping subterranean fluids out of a hole formed in the surface of the earth comprising:

submersible pump means for pumping a fluid in which the pump means is submersed;

a flexible support cable attached to the pump means;

support means at the surface of the earth attached to the flexible support cable for supporting the pump means and the support member in the hole;

flexible power conductor means coupled to the pump means and the support means for supplying power to the pump means; and flexible fluid transport means coupled to the pump means and the support means for transporting pumped fluid from the pump means to the surface of the earth;

the flexible support cable, the power conducting means and the fluid transport means being arranged separate from but parallel to each other and being encased together in a common protective sheath.

5. A system as in claim 4 further comprising transducer means attached to the pump means for sensing a physical property of the fluid in the hole.

6. A system as in claim 5 wherein the transducer means is a pressure transducer.

7. A system as in claim 5 further comprising control means coupled to the transducer means and the pump means for controlling the pump means in response to the transducer means.

8. A system as in claim 7 wherein the transducer means is a pressure transducer and the control means causes power to be supplied to the pump means in response to the transducer means sensing a first pressure and halts the supply of power to the pump means in response to the transducer means sensing a second pressure.

9. A system as in claim 8 further comprising signal conducting means coupled between the pump means and the support means.

10. A system as in claim 8 wherein the control means is located on the surface of the earth and is connected to the transducer means by the signal conducting means and to the pump means by the power conducting means.

11. A system as in claim 9 further comprising sonic transducer means attached to the pump means and coupled to the signal conducting means for creating sonic disturbances in the hole to increase the production rate of the fluid from the earth.

12. A system as in claim 4 further comprising motive means on the surface of the earth connected to the support member for inserting the pump means into and retracting the pump means from the hole.

13. A system as in claim 12 wherein the motive means includes reel means around which the support cable is wound when the pump means is retracted from the hole and from which the support cable is unreeled when the pump means is inserted into the hole.

14. A system as in claim 12 wherein the motive means includes reel means around which the support cable, the power conducting means and the fluid transport means are wound together when the pump means is retracted from the hole and from which the support cable, the power conducting means and the fluid transport means are unreeled together when the pump means is inserted into the hole.

15. A system as in claim 14 further comprising a removable junction box connected to the support cable, the power conducting means, the fluid transport means and the signal conducting means at the surface of the earth wherein the junction box is wound on the reel means when the pump means is retracted from the hole.

16. A system for pumping subterranean oil out of a hole formed in the earth and lined with a casing, the system comprising:

submersible pump means for pumping oil in which the pump means is submersed;

a flexible support cable attached to the pump means;

support means at the surface of the earth attached to the flexible support cable for supporting the pump means and the support cable in the casing;

flexible power conductor means coupled to the pump means and the support means for supplying power to the pump means;

flexible oil transport means coupled to the pump means and the support means for transporting pumped oil from the pump means to the surface of the earth;

a transducer attached to the pump means;

signal conducting means coupled between the transducer and the support means;

motive means on the surface of the earth connected to the support cable for inserting the pump means into and retracting the pump means from the casing, the motive means including reel means around which the support cable, the power conducting means and the oil transport means are wound together when the pump means is retracted from the casing and from which the support cable, the power conducting means and the oil transport means are unreeled together when the pump means is inserted into the casing; and a removable junction box connected to the support cable, the

17. A system as in claim 16 wherein the flexible support cable, the power conducting means, the oil transport means and the signal conducting means are arranged separate from but substantially parallel to each other and are encased in a common protective sheath.

18. A system for pumping subterranean oil out of a hole formed in the earth comprising:

a casing lining the hole and having perforations to allow the oil to flow into the casing;

submersible, positive displacement, electrically operated pump means for pumping the oil in which the pump means is submersed;

a flexible support cable attached to the pump means;

support means at the surface of the earth attached to the flexible support cable for supporting the pump means and the support cable in the hole;

flexible electrical power conductor means coupled to the pump means and the support means for supplying electrical power to the pump means;

flexible oil transport means coupled to the pump means and the support means for transporting pumped oil from the pump means to the surface of the earth;

motive means on the surface of the earth connected to the support member for inserting the pump means into and retracting the pump means from the casing, the motive means including reel means around which the support cable, the electrical power conducting means and the oil transport means are wound together when the pump means is retracted from the casing and from which the support cable, the electrical power conducting means and the fluid transport means are unreeled together when the pump means is inserted into the casing; and a removable junction box connected to the support cable, the electrical power conducting means, the oil transport means and the signal conducting means at the surface of the earth wherein the junction box is wound on the reel means when the pump means is retracted from the casing.

19. A system as in claim 18 further comprising signal conducting means coupled between the pump means and the support means and wherein the flexible support cable, the electrical power conducting means, the oil transport means and the signal conducting means are arranged separate from but substantially parallel to each other and are encased in a common protective sheath.

* * * * *